United States Patent [19]

Gassner et al.

[11] 4,020,710

[45] May 3, 1977

[54] FRICTION DISC FOR FALSE TWISTING DEVICES

[75] Inventors: Hans Gassner; Otto Lang, both of Schweinfurt, Germany

[73] Assignee: Kugelfischer Georg Schafer & Co., Schweinfurt, Germany

[22] Filed: June 12, 1975

[21] Appl. No.: 586,378

[30] Foreign Application Priority Data

June 12, 1974 Germany ..... 2428514

[52] U.S. Cl. ..... 74/206; 74/215; 57/77.45; 57/103

[51] Int. Cl.[2] ..... D01H 7/92; B21B 27/00

[58] Field of Search ..... 74/206, 214, 215, 229, 74/230.5; 57/77.45, 103

[56] References Cited

UNITED STATES PATENTS 2,850,338 9/1958 Kopczynski ..... 74/206 X

*Primary Examiner*—Samuel Scott
*Assistant Examiner*—Allan R. Burke
*Attorney, Agent, or Firm*—Stevens, Davis, Miller & Mosher

[57] ABSTRACT

A friction disc for rotating a twisting tube of a false twisting device for crimping thread is provided with a peripheral surface which slings any oil on the surface therefrom. The peripheral surface of the disc has an annular groove therein which is substantially frusto-conically shaped in cross-section and intersects the surface at an angle to provide an edge from which the oil will be slung by centrifugal force as the disc rotates.

7 Claims, 4 Drawing Figures

FRICTION DISC FOR FALSE TWISTING DEVICES

Figure 1:
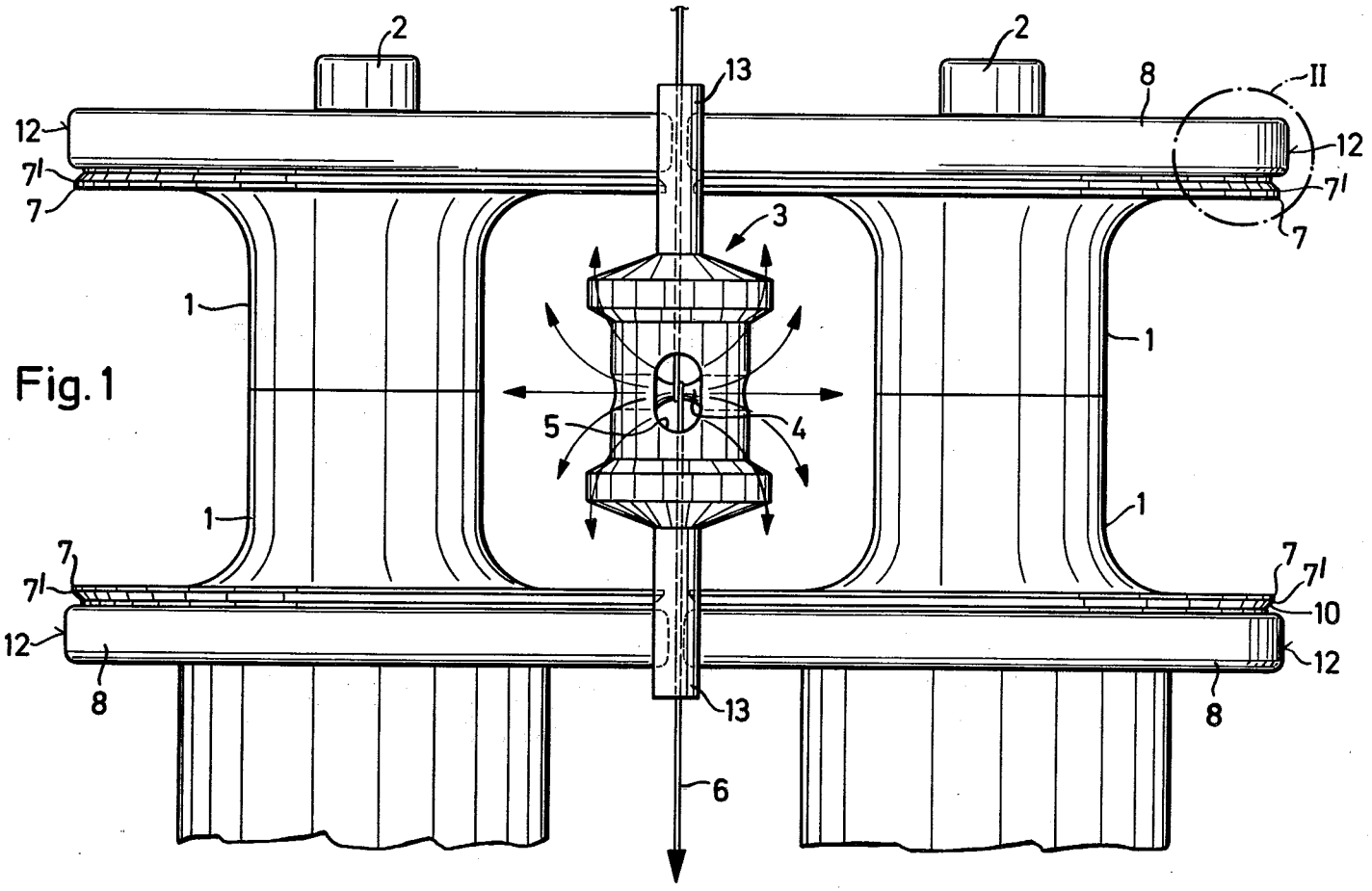

This invention relates to a friction disc for frictionally driving a twisting tube of a false twisting device for crimping synthetic yarns.

These friction discs can be made as a complete homogeneous body, that is to say a molded one-piece disc of elastic synthetic resin material, for example, a polyurethane elastomer of suitable hardness. Also, two-piece discs are known having a hub of nonresilient material (i.e. substantially rigid material) for example, aluminum, an aluminum alloy or a suitable rigid or hard synthetic resinous material having an annular peripheral flange and, secured to its peripheral flange a friction ring of elastic synthetic resinous material, for example, polyurethane elastomer of suitable harndess. See, for example, DT-AS 1 525,149, the disclosure of which is incorporated herein by reference. In each case the periphery of the friction disc is, therefore, made of resilient synthetic resin.

In false twisters employing such friction discs a twisting tube engages the peripheries of the discs and with disc speeds of, for example, 40,000 r.p.m. the tube rotates at a high speed of, for example, up to 800,000 r.p.m. At least one of the friction discs or a pair of the friction discs which are mounted on the same spindle is driven. The twisting tube is retained in engagement with the discs, for example, by magnets associated therewith.

A thread runs through the twisting tube at high speed. The thread passes around a transversely extending twist pin which is disposed either at one end of the tube or at its middle. It is preferred to place the twist pin near the middle of the tube in false twisting tubes designed to rotate at extremely high speeds. Each of the tubes has at least one transverse opening in the region of the twist pin to permit threading of the thread around the twist pin.

During false twisting, the thread to be twisted runs under a predetermined tension over the surface of the twist pin and is thereby compressed so that spinning oil which is sticking to the thread is scraped off or, in the case of a thread made up of several strands, it is squeezed out. As a consequence of the high centrifugal forces which are present, the spinning oil is flung through the above-mentioned transverse opening or openings and coats the adjacent components of the false twising apparatus, in particular, those regions of the friction discs which face the twist pin.

This is disadvantageous because the spinning oils, in particular, those used in crimping, contain components which attack the periphery of the friction discs which are made of materials chosen because of their high stresses, such as, for example, polyurethane elastomers of predetermined hardness. This attack is all the more serious because clean friction disc peripheries are necessary for the smooth running of the twisting tube at maximum speeds of rotation.

The coating of spinning oil causes the peripheries of the friction discs to lose their good running characteristics for the associated twisting tubes and these peripheries swell up and wear at the periphery after a short time. It is impractical, not only because of the limited space available, but also because complicated equipment is required to suck away the coating of spinning oil mist to avoid these damaging effects.

Accordingly, an object of this invention is to solve the problem of overcoming these drawbacks and to prevent by a simple means, deterioration of the peripheries of friction discs caused by spinning oil which emerges from an associated twisting tube during false twisting. Another object of the invention is to provide a friction disc having a peripheral edge of a shape whereby liquid on the surface of the disc is thrown therefrom as the disc is rotated.

Figure 2:
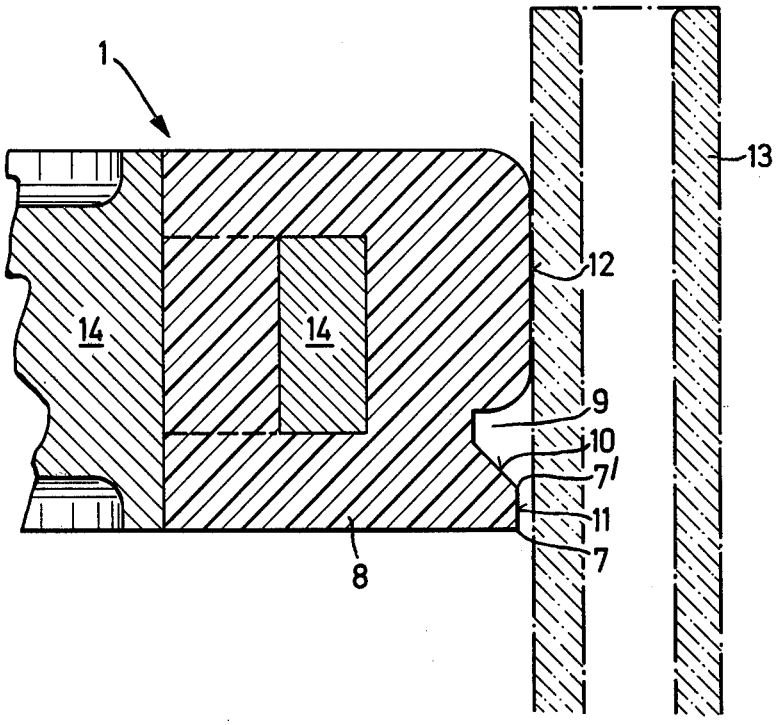
Figure 3:
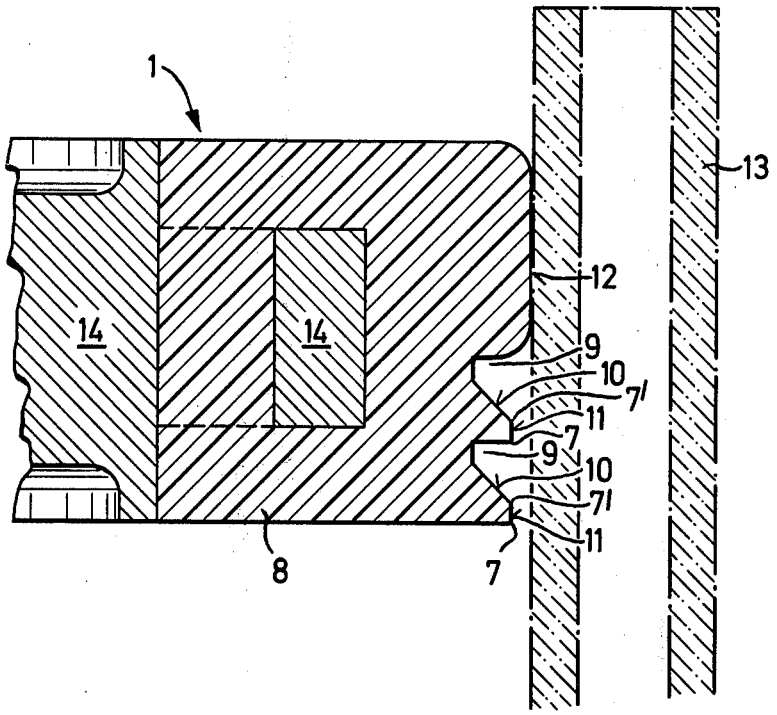
Figure 4:
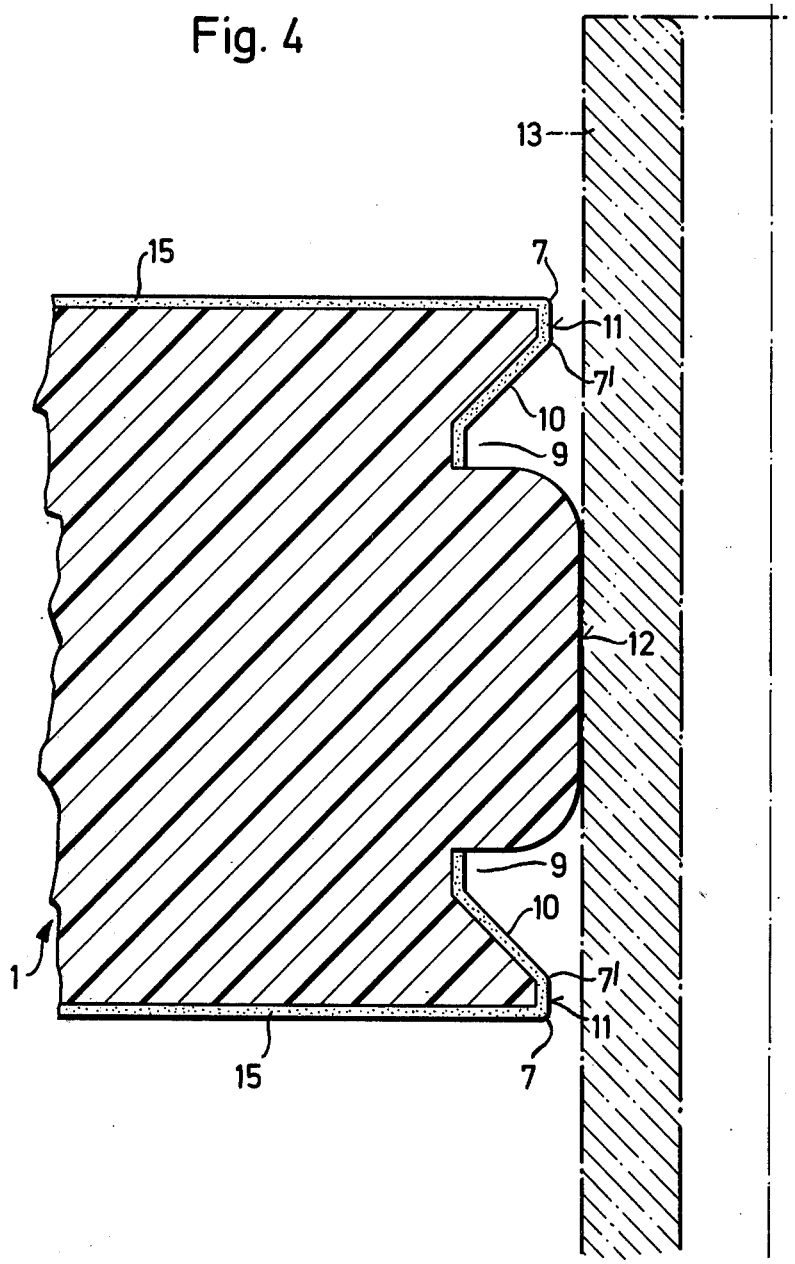

Other objects will become apparent from the following description with reference to the accompanying drawing wherein FIG. 1 is a side view of two mutually parallel pairs of friction discs of a false twister which are engaged by a twisting tube which has its twist pin arranged in the middle region of its length, the peripheries of the friction discs being shaped in accordance with one embodiment of the invention; and FIGS. 2 to 4 each illustrate on a larger scale, in longitudinal section through the friction disc of FIG. 1, second and third embodiments, respectively, of the peripheries of the friction discs provided by the invention.

The foregoing objects and others are accomplished in accordance with this invention, generally speaking, by providing a friction disc for false twisting devices of the kind described hereinbefore having a resilient peripheral surface comprising at least two points from which liquid on the disc will be thrown by centrifugal force when the disc rotates.

At least on that face of the friction disc at which during false twisting the twist pin of the associated twisting tube is present, one or more adjacent "slinger edges" are provided, extending along the periphery of the friction disc. The friction disc can be formed both as a one-piece disc or in two parts with a relatively rigid carrier and a relatively resilient friction ring. Preferably, each slinger edge is formed directly on the periphery of the friction disc or of the ring by an annular groove.

To provide additional protection for the friction disc from damage to the tube-engaging running surface by spinning oil, the periphery of the disc or ring adjacent to the twisting tube may be coated with a protective coating. A suitable protective lacquer which, on the one hand, adheres tightly to the elastic synthetic resin of which the periphery of the friction disc is made, and, on the other hand, is resistant to the spinning oil may be used for this purpose.

Referring now to the drawing, the false twister shown in FIG. 1 has two mutually parallel pairs of friction discs 1. The two discs 1 of each pair are secured on a spindle 2. The two spindles 2, which are mutually parallel, are mounted to rotate in bearings in the conventional manner. By means of magnets, which are not shown, a false twisting tube 3 is held in the wedge-shaped gap between the two pairs of friction discs to be driven by them. For this purpose, one of the spindles 2 is driven, rotating the tube 3 and thereby causing the discs 1 on the other spindle 2 to rotate as well.

The twisting tube 3 has a centrally disposed transverse twist pin 4 and two mutually aligned transverse openings 5 which form a passage extending transversely with respect to the pin 4 to allow initial threading up of the thread 6 around the pin 4.

In operation the thread 6 passes at high speed through the twisting tube 3. Where it passes around the pin 4 the thread 6 is squeezed so that the spinning oil which is sticking to it is scraped off or, in the case thread 6 is made up of a number of strands, it is squeezed out, and by virtue of the high centrifugal forces arising at the high speeds of rotation, the oil is flung out of the openings 5 in the form of a mist as indicated by the arrows in FIG. 1. To protect its running surfaces against the spinning oil each friction disc 1 is provided, with a slinger edge 7, on that face of it which is towards the twist pin 4 on the twisting tube 3.

As shown clearly in FIG. 2, the slinger edge 7 is separated from the cylindrical running surface of the friction ring 8 by a groove 9 extending around the periphery of a friction ring 8 of the disc 1 in question, the groove 9 being of a special cross-sectional shape with a substantially frusto-conical side wall 10 which slopes towards the adjacent face of the friction disc. The side wall or flank 10 of the groove 9 which is nearest the adjacent face of the friction disc is inclined at an angle of about 45° to the longitudinal axis of the disc and associated spindle 2. Thereby any spinning oil which passes over the slinger edge 7 towards the groove 9 is urged up the inclined flank 10 by centrifugal force, towards the edge 7′ and from this edge 7′ it is flung off. The slinger edges 7 and 7′ thereby prevent the spinning oil from passing to the running surface 12 of the friction ring 8.

The cylindrical portion of the ring between the slinger edges 7 and 7′ has a smaller diameter than the running surface 12 so running surfaces 13 of the twisting tube 3 are only in contact with the running surface 12.

The friction disc 1 shown in FIG. 3 differs from that of FIG. 2 only in that, on the side of the ring 8 which is towards the twist pin 4 on the tube 3, there are provided two annular grooves 9 of the general cross-sectional shape of the one illustrated in FIG. 2, so that the number of slinger edges 7 and 7′ is doubled. Just as in the embodiment of FIG. 2, the friction disc 1 comprises a hub with an annular flange 14 which is surrounded by the friction ring 8 which is secured to it. The hub complete with it annular flange 14 is made of a non-resilient material, for example, aluminum or an aluminum alloy or a suitable rigid plastic material and the friction ring 8 is made of a resilient synthetic resin, for example, polyurethane of suitable hardness.

In FIG. 4, there is illustrated a friction disc 1 which is formed as a single body of elastic frictional material usually a synthetic resin, for example, polyurethane of suitable hardness. On the periphery of this complete disc 1 there is provided on both sides of the running surface 12 an annular groove 9 of the particular cross-sectional shape described, with frustoconical side flanks 10 so that slinger edges 7 and 7′ are produced at both sides of the friction disc. A cylindrical radially projecting running surface 12 extends between the two annular grooves 9.

The faces of the friction disc 1, the cylindrical disc portions 11, the side flanks 10 and the closed ends of the grooves 9 may be, as shown in FIG. 4, provided with a protective layer 15 of suitable lacquer. This protective layer 15 may be applied over a restricted region covering only the faces of the friction disc 1, if desired.

This protective layer 15 may also be provided in the embodiments of FIGS. 2 and 3, and in fact on the side face of the friction disc 1 which is adjacent to the slinger edges 7 and 7′, the protective layer 15 being capable also of extending into the annular groove 9. Furthermore, the friction discs 1 according to FIGS. 2 and 3 may be formed in one piece. Likewise, the disc illustrated in FIG. 4 may be formed as a two-piece disc with a relatively rigid hub or carrier and a relatively resilient peripheral friction ring.

Although the invention is described in detail for the purpose of illustration it is to be understood that such detail is solely for that purpose and that variations can be made therein by those skilled in the art without departing from the spirit and scope of the invention except as it may be limited by the claims.

What we claim is:

1. A friction disc for a false twisting device or crimping thread, said device having a twisting tube, said friction disc having a pair of faces and a peripheral surface therebetween, said peripheral surface when the disc is associated with the tube on the false twisting device being in the path of oil flung from the thread by the tube as the thread is twisted, that face of the disc which faces the said tube intersecting the said surface in an abrupt edge from which oil flowing over the face towards the surface will be thrown by centrifugal force as the disc rotates, and an annular groove in said peripheral surface adjacent to but spaced from said abrupt edge, said groove having a closed end of smaller cross-section than the cross-section of its open end and an inclined wall between the closed end and mouth adjacent to the said abrupt edge intersecting the surface to form a second edge from which any oil moving over the first edge on said surface is removed by centrifugal force as the disc rotates.

2. A friction roller for driving a twist tube of a false twisting apparatus for crimping a thread comprising a friction ring having a peripheral surface which comprises a running surface, a first face adjacent to the twist tube and an opposite face, and means for protecting the running surface from oil thrown from the thread as the twist tube rotates comprising a first slinger edge at the juncture between the peripheral surface and the said first face, and a second slinger edge on said peripheral surface spaced axially from the first sllinger edge towards the running surface.

3. The friction roller of claim 2 wherein an annular groove is disposed in the said peripheral surface between the said first and second slinger edges, said groove having a frustoconical surface inclined inwardly from the first slinger edge and a second surface which terminates to form the second slinger edge.

4. The friction roller of claim 3 wherein the said inclined surface is inclined at about 45° with the axis of the roller.

5. The friction roller of claim 3 wherein the said peripheral surface has two axially spaced grooves and a cylindrical surface between the grooves of smaller diameter than the diameter of the running surface.

6. The friction roller of claim 3 wherein the face thereof facing the twist tube has a protective coating.

7. The friction roller of claim 6 wherein the protective coating extends into the groove and said running surface is uncoated.

* * * * *